United States Patent [19]

Keeny

[11] 4,023,481

[45] May 17, 1977

[54] DOUBLE FACER PLATEN

[75] Inventor: Thomas R. Keeny, Lindenwold, N.J.

[73] Assignee: Molins Machine Company, Inc., Cherry Hill, N.J.

[22] Filed: Sept. 17, 1975

[21] Appl. No.: 614,050

[52] U.S. Cl. ..... 100/93 P; 156/583; 425/406

[51] Int. Cl.[2] ..... B30B 15/34

[58] Field of Search ..... 100/93 P; 156/583; 425/383, 406, 384, 233

[56] References Cited

UNITED STATES PATENTS

| | | | |
|---|---|---|---|
| 1,290,105 | 1/1919 | Davenport | 425/384 |
| 1,947,335 | 2/1934 | DeMattia | 425/233 |
| 3,393,292 | 7/1968 | Ritscher | 100/93 P |
| 3,453,950 | 7/1969 | Pfeiffer | 100/93 P |
| 3,482,510 | 12/1969 | Fickler | 100/93 P |
| 3,646,992 | 3/1972 | Ishizawa et al. | 100/93 P |

*Primary Examiner*—Richard E. Aegerter
*Assistant Examiner*—L. Footland
*Attorney, Agent, or Firm*—Seidel, Gonda & Goldhammer

[57] ABSTRACT

A double facer platen is constructed so as to utilize a liquid heating medium which flows through a chamber containing a labyrinth defining a flow passage whose cross-sectional area decreases in the direction of flow from an inlet toward an outlet. The platen is adapted for use with liquids which have a temperature in excess of 400° F. and a pump pressure of about 50 psi.

13 Claims, 6 Drawing Figures

DOUBLE FACER PLATEN

BACKGROUND OF THE INVENTION

The subject matter involved herein is broadly classified in class 156, subclass 210. Representative prior art is exemplified by U.S. Pat. No. 3,607,523.

For many years, the platens of a double facer were heated by steam. Steam heat has certain disadvantages such as structural considerations due to the high pressure of steam when steam is at the temperature used in a double facer machine. Each steam heated platen is a potential source of danger when in operation due to the high pressure and the compressed state of the steam. Further, there is a limit to the practical upper temperature range for steam and hence a practical upper temperature for heat to be transferred to a web which in turn is a limiting factor on the speed of the web.

The liquid heated platen for use in a double facer in accordance with the present invention is constructed in a manner so as to have a flat planar top surface on a main plate for transferring heat to a web in contact therewith. The main plate is connected to a lower plate therebelow with a peripheral spacer therebetween and sealed to said plates to thereby define a shallow heating chamber between said plates. The chamber is provided with an inlet and an outlet. The chamber inlet is preferably closer to an upstream portion of said plates as compared with said outlet.

The liquid heated platen of the present invention is rigid as a result of beam means connected to the lower plate for maintaining the plates flat and rigid. A means is provided in the chamber to divide the chamber into a labyrinthine flow passage which decreases in cross-sectional area from said inlet to said outlet.

The liquid heated platen of the present invention will enable the double facer machine to be operated at a speed up to 30% greater than the speed of a double facer using steam heated platens. When using a liquid heating medium, such as oil, the vapor pressure is only about 2 psi at 450° F. and a pump is used for circulation. Whereas, with steam the temperature and pressure increase simultaneously at different rates. For example, oil can have a temperature of 450° F. at a pump pressure of 50 psi while steam at the same temperature will result in pressures in excess of 400 psi.

It is an object of the present invention to provide a liquid heated platen for a double facer to facilitate attainment of higher temperatures with lower pressures as compared with steam and various advantages resulting therefrom such as savings in installation, savings in maintenance, etc.

Other objects appear hereinafter.

For the purpose of illustrating the invention, there is shown in the drawings a form which is presently preferred; it being understood, however, that this invention is not limited to the precise arrangements and instrumentalities shown.

Referring to the drawings in detail, wherein like numerals indicate like elements, there is shown a liquid heated platen for use in a double facer machine structurally interrelated with other components of the double facer such as is shown in the above-mentioned U.S. Pat. No. 3,607,523.

Figure 1:
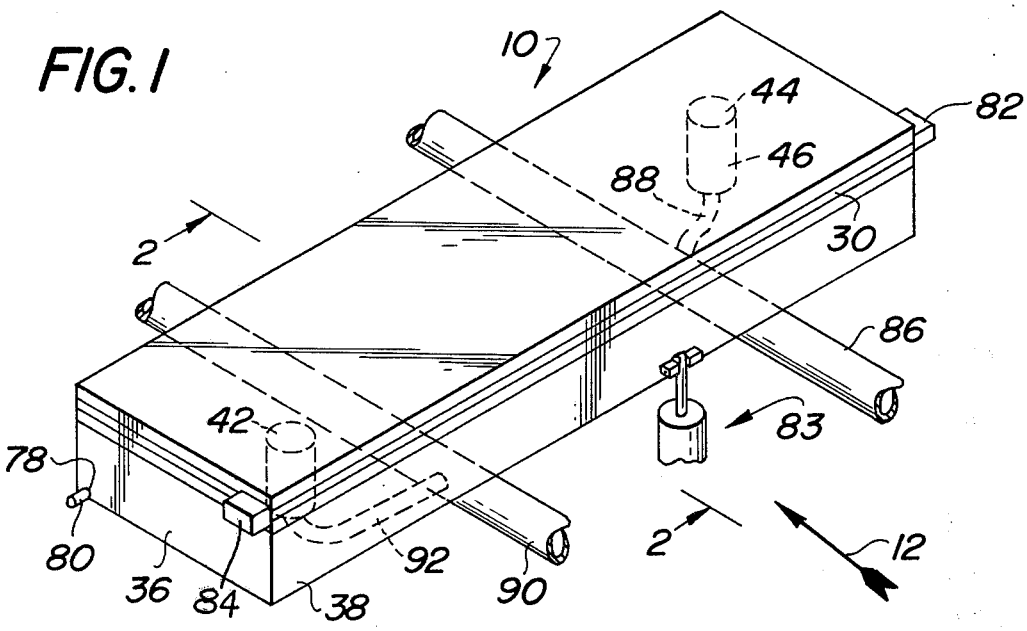
FIG. 1 is a perspective view of a platen in accordance with the present invention on a reduced scale.
Figure 2:
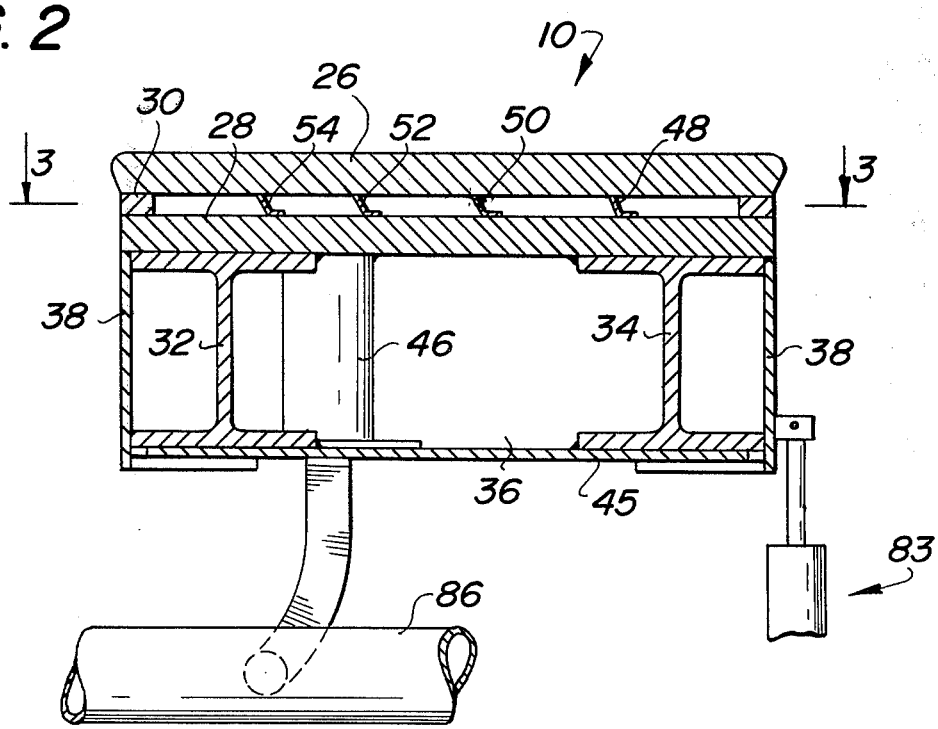
FIG. 2 is a sectional view taken along the line 2—2 in FIG. 1 on an enlarged scale.

The liquid heated platen 10 is adapted to be installed in the double facer with the components thereof arranged to transfer heat to a web travelling in the direction of arrow 12. Thus, the platen 10 has an upstream portion and a downstream portion as related to the direction of arrow 12.

The upper surface of the platen 10 is defined by an elongated main plate 26 having a preferred thickness in excess of ½ inch and having a flat planar top surface. A lower plate 28 has substantially the same peripheral dimensions as plate 26 but may be thinner than plate 26. A peripheral spacer 30 separates the plates 26 and 28 to define a chamber 40 therebetween. Spacer 30 is sealed to the plates 26 and 28 in any convenient manner. Such sealing of spacer 30 is preferably attained by welding. Spacer 30 may be an integral flange on one of said plates.

A platen 10 is typically provided with a length of 85–110 inches. The platen 10 is rendered rigid by longitudinally extending beam means. The beam means is preferably in the form of I-beams 32, 34 which extend for the full length of the platen 10 along opposite sides. The beams 32, 34 are preferably joined to the lower plate 28 by welding. Metal end walls 36 and metal side walls 38 may be provided on the platen 10 to stiffen and obscure the beams 32 and 34. Beams 32, 34 may be C-shaped or have some other shape instead of an I-shape.

The chamber 40 is shallow. In a typical embodiment of the present invention, chamber 40 has a vertical height of about one-half inch. Chamber 40 has an inlet 42 and an outlet 44 spaced from one another. Preferably, the inlet and outlet are spaced inwardly from the periphery of chamber 40 so as to be surrounded on all sides by a flow passage.

Figure 6:
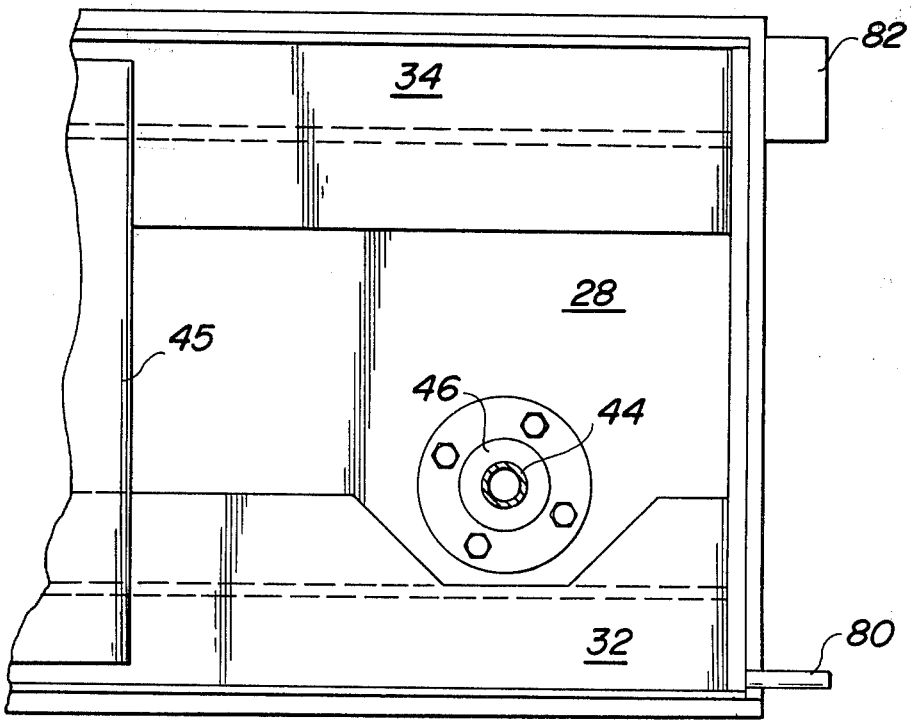
FIG. 6 is a partial bottom view.

Each of the inlet and outlet has a pipe extending therefrom in a vertical direction to an elevation at or below the elevation of the beams 32, 34 for ease of access of coupling. Thus, the outlet 44 is provided with a pipe 46. As shown in FIG. 6, the beam 32 is provided with a cut-out portion to accommodate the pipe 46 and its mounting flange. The beams 32, 34 are transversely innerconnected by one or more brace plates 45.

Figure 3:
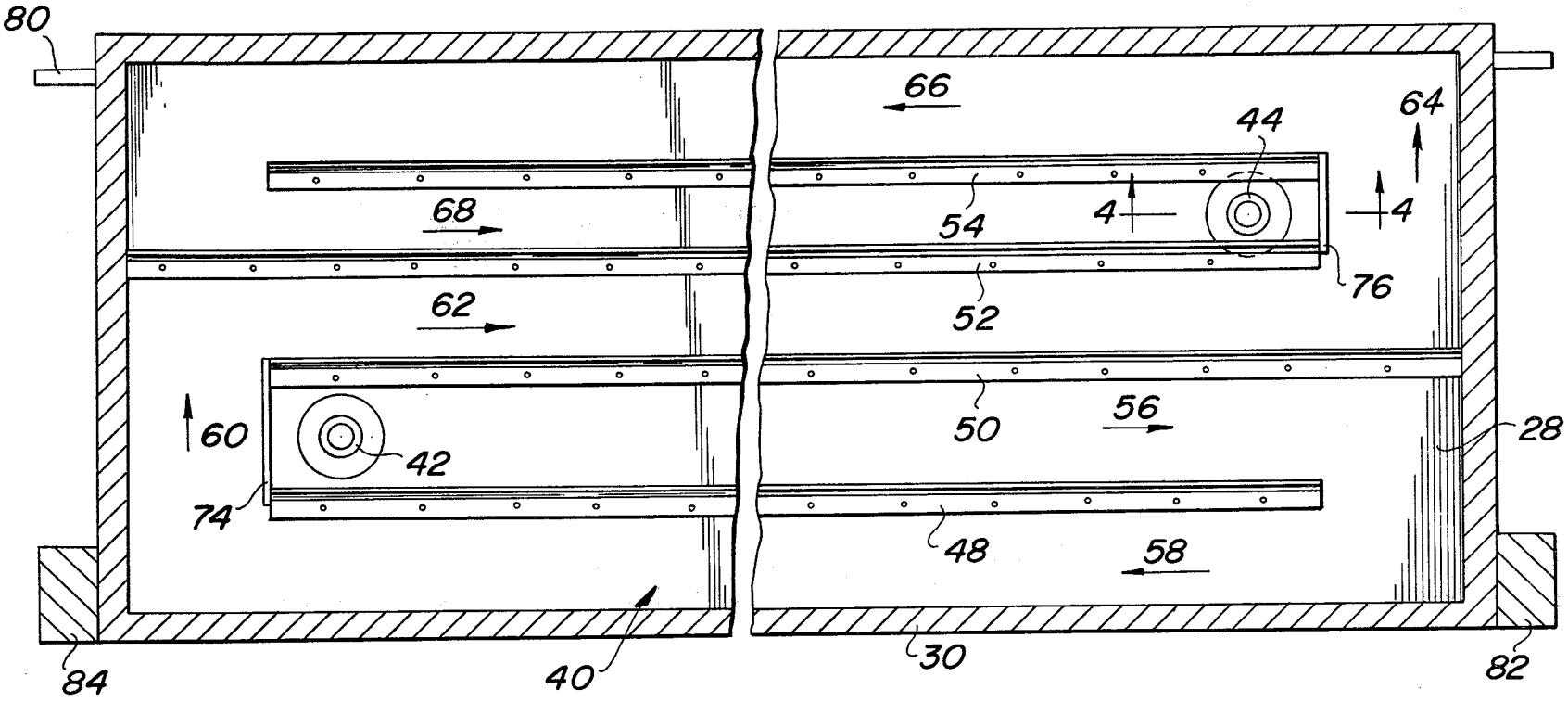
FIG. 3 is a sectional view taken along the line 3—3 in FIG. 2.
Figure 4:
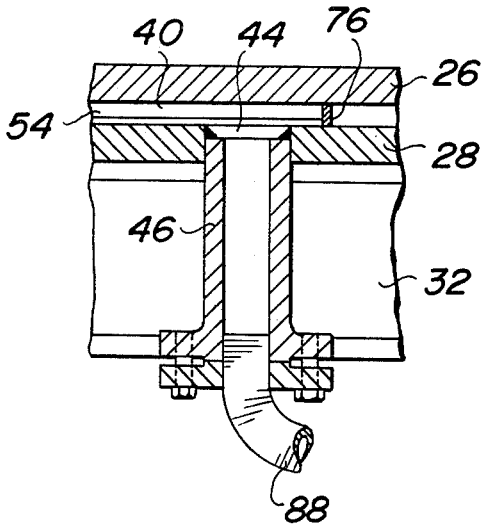
FIG. 4 is a sectional view taken along the line 4—4 in FIG. 3.
Figure 5:
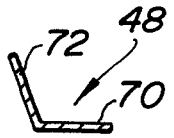
FIG. 5 is a cross-sectional view of a divider.

The chamber 40, as shown more clearly in FIG. 3, is divided in a labryinthine path extending from the inlet 42 to the outlet 44. Such division of the chamber 40 is attained by means of dividers 48, 50, 52 and 54. The dividers 48–54 are identical in cross-section as shown in FIG. 5. Thus, divider 48 includes a horizontally disposed leg 70 and a leg 72 inclined at an angle of about 60° with the horizontal. The dividers are made from flexible sheet metal. Leg 70 is preferably spot welded or otherwise joined to the lower plate 28.

In FIG. 3, the righthand end of the dividers 48, 50 are innerconnected by a vertical divider 74 secured at its lower end to the plate 28 in any convenient manner such as by welding. In a similar manner, adjacent ends of dividers 52, 54 are innerconnected by a vertically disposed divider 76 joined at its lower edge to the plate 28 in any convenient manner such as by welding. Dividers 74, 76 have a height corresponding to the desired height of chamber 40. The height of leg 72 of each of the dividers is greater than the desired height of chamber 40. Leg 72 is flexible and will flex downwardly when the main plate 26 is installed.

The dividers described above divide the chamber 40 into a continuous labyrinth extending from the inlet 42 to the outlet 44 and defined by flow passages 56, 58, 60, 62, 66 and 68. The flow passages 56–68 decrease in the direction of flow from the inlet 42 to the outlet 44. For example, flow passage 56 may have a transverse width of 3¾ inches whereas flow passage 68 may have a transverse width of 2½ inches. Flow passage 56 is 1.5 to 2.7 times as wide as flow passage 68.

The widest flow passage, namely flow passage 56, is closer to the upstream edge of the platen 10 as compared with its distance to the downstream edge thereof. Thus, the liquid medium flowing from the inlet 42 to the outlet 44 will increase in velocity as it moves toward the outlet 44. As the velocity of the liquid medium increases, its heat transfer rate to the plate 26 will increase. In this manner, there is compensation provided for the decrease in the temperature of the liquid medium as it flows from the inlet 42 to the outlet 44 whereby the temperature of plate 26 will be substantially uniform across its entire width and length.

In order to support the platen 10 for moving the upper surface of plate 26 toward and away from the plane of the web, the platen 10 may have a notch 78 at the lower rear corner at each end thereof to facilitate receiving a shaft 80. The plate 10 is adapted to pivot about the longitudinal axis of shaft 80 similar to the pivotable movement disclosed in said U.S. Pat. No. 3,607,523. The actuator for attaining pivotal movement is diagrammatically disclosed herein at 83 and may be of the type as shown in said patent. Further, the platen 10 may be caused to move in a vertical direction toward and away from the plane of the paper if desired.

The platen 10 is provided with outwardly extending lugs 82, 84 at opposite ends thereof adjacent the upper edge of the upstream portion of the platen 10. The lugs 82, 84 are adapted to cooperate with adjustment of ballast rolls in the manner of lugs 36, 38 of said U.S. Pat. No. 3,607,523.

The pipe 46 associated with outlet 44 is connected to a manifold conduit 86 by way of a flexible hose 88. Similarly, the corresponding pipe associated with the inlet 42 is connected to a supply conduit 90 by way of a flexible hose 92. Each of the platens of the double facer is similarly connected to the conduits 86, 90.

The liquid circulated through the chamber 40 may be any one of a wide variety of heat transfer liquids generally characterized as being "oils" and having the high boiling point in excess of 600° F. Suitable "oils" which may be used, are sold commercially as Mobiltherm 603 or Therminol 55. These so-called oils are non-corrusive, are designed for long life, low maintenance and have boiling points in excess of 600° F.

Liquid heated platens in accordance with the present invention utilize oils at a substantially lower pressure as compared with pressures associated with steam. Thus, lighter piping and conduits as well as less piping conduits may be utilized in connection with oil heated platens. In comparison with steam-heated platens which are generally made of cast iron, the platen 10 is lighter in weight, utilizes thinner walls and facilitates the use of higher temperatures which in turn facilitate a substantial increase in web speed.

The present invention may be embodied in other specific forms without departing from the spirit or essential attributes thereof and, accordingly, reference should be made to the appended claims, rather than to the foregoing specification as indicating the scope of the invention.

It is claimed:

1. A heat transfer platen for use in a double facer and adapted for receiving a heat transfer liquid comprising a main plate having a flat planar top surface for contact with a web, a lower plate, a peripheral spacer between said plates and defining the periphery of a sealed chamber between said plates for receiving the heat transfer liquid, said chamber having an inlet and an outlet, said inlet being closer to an upstream portion of said plates than said outlet, a beam means connected to said lower plate to maintain the plates rigid, means in said chamber defining a continuous labyrinthine passage for flow of the heat transfer liquid between said inlet and outlet, said passage definded by a plurality of interconnected straight parallel dividers with flow through adjacent portions of said passage being in opposite directions, the distance between successive parallel dividers decreasing whereby the velocity of the heat transfer liquid flowing in said passage portions progressively increases.

2. A platen in accordance with claim 1 wherein said beam means includes first and second beams having a vertical height substantially greater than the height of said chamber and at least one flange adjacent the lower edges of said beams, and means interconnecting said beams adjacent their lower flanges.

3. A platen in accordance with claim 1 wherein said main plate has a thickness greater than ½ inch and said chamber has a height less than the thickness of said main plate.

4. A platen in accordance with claim 3 wherein said flow passage begins at said inlet and terminates at said outlet, said flow passage including at least three parallel portions.

5. A platen in accordance with claim 1 wherein each of said inlet and outlet communicate with said chamber through a hole in said lower plate, a pipe secured to said lower plate while surrounding the inlet and terminating adjacent the lower edge of said beam means, a second pipe secured to said lower plate while surrounding said outlet and terminating at its lower end adjacent the lower edge of said beam means.

6. A platen in accordance with claim 1 wherein said means for defining the labyrinthine flow passage in said chamber includes a plurality of longitudinally extending generally parallel dividers, each divider having a length less than the length of the chamber, the longitudinally extending dividers having a first leg fastened to one of said plates and a second leg inclined at an acute angle with respect to said one plate.

7. A platen for use in a web processing machine and adapted to have a heated liquid flowing therethrough so that a surface of the platen may transfer heat to a web by contact with the web comprising a main plate having a surface for contact with a web, a lower plate having substantially the same periphery as said main plate, a spacer between said plates at the periphery of said plates to define a sealed shallow chamber between said plates, said chamber having an inlet and an outlet communicating therewith through said lower plate, a beam means connected to the lower plate to maintain the plates rigid, said plates being substantially longer than their width, said beam means extending longitudinally along said lower plate, means in said chamber defining a labyrinthine flow passage including a plurality of longitudinally extending parallel portions, the width of said portions decreasing in the direction of said flow passage from said inlet to said outlet, and means for supporting the platen for movement with respect to a web in a manner so that at least a major portion of the uppermost surface of said main plate may be spaced from a web to decrease heat transfer from said surface to the web.

8. A platen in accordance with claim 7 wherein said inlet and said outlet are adjacent opposite corners of said chamber, said chamber being rectangular, and the height of said chamber being approximately ½ inch.

9. A platen in accordance with claim 7 wherein said means in the chamber defining a labyrinthine flow passage includes a plurality of parallel dividers having a length less than the length of said chamber, each divider being fastened to said lower plate and having a leg extending upwardly at an acute angle into contact with said main plate.

10. A platen in accordance with claim 7 wherein said beam means includes first and second longitudinally extending I-beams having a vertical height substantially greater than the height of said chamber, and means interconnecting said beams at a location adjacent their lower flanges to increase the torsional and bending stiffness thereof.

11. A platen in accordance with claim 7 including a rigid pipe surrounding said inlet, said pipe being fastened to said lower plate and extending downwardly therefrom for a distance at least as great as the height of said beam means, a second pipe surrounding said outlet, said second pipe having one end fastened to said lower plate, the height of said second pipe being at least as great as the height of said beam means.

12. A platen in accordance with claim 7 wherein the ratio of the widest portion to the narrowest portion of said labyrinthine flow passage is between 1.5 and 2.7.

13. A platen in accordance with claim 7 wherein said flow passage is a single continuous passage for flow between said inlet and outlet with a plurality of parallel portions having flow in opposite directions.

* * * * *